US005881977A

United States Patent [19]

Danneberg

[11] Patent Number: 5,881,977

[45] Date of Patent: Mar. 16, 1999

[54] HOLDING DEVICE

[75] Inventor: Holger Danneberg, Suhlendorf, Germany

[73] Assignee: Werkhaus Design + Produktion GmbH, Suhlendorf, Germany

[21] Appl. No.: 702,041

[22] Filed: Aug. 23, 1996

[30] Foreign Application Priority Data

Aug. 25, 1995 [DE] Germany ..... 195 31 371.2

[51] Int. Cl.[6] ..... A47G 23/02

[52] U.S. Cl. ..... 248/150; 206/485; 206/805; 40/436; 40/174

[58] Field of Search ..... 248/150, 152, 248/436, 174, 167; 40/538, 792, 794; 206/486, 485, 805; 220/4.22, 4.24

[56] References Cited

U.S. PATENT DOCUMENTS

| | | | |
|---|---|---|---|
| 2,870,558 | 1/1959 | Fuller | 40/538 |
| 2,895,834 | 7/1959 | Brav | 40/538 X |
| 3,116,738 | 1/1964 | Wentges | 206/805 X |
| 3,586,276 | 6/1971 | O'Mahoney | 248/150 X |
| 4,201,294 | 5/1980 | Roccaforte | 248/152 X |
| 4,375,262 | 3/1983 | Hrenyo | 220/4.23 X |
| 4,531,637 | 7/1985 | Cusmano | 248/152 X |
| 4,549,654 | 10/1985 | Tiesman | 248/152 X |
| 4,623,112 | 11/1986 | Olson . | |
| 4,840,276 | 6/1989 | George | 206/499 |
| 4,894,247 | 1/1990 | Fong | 206/805 X |
| 4,971,275 | 11/1990 | Roberts | 248/152 |
| 5,007,606 | 4/1991 | Allen et al. | 248/152 |
| 5,012,600 | 5/1991 | Wang | 40/792 X |
| 5,090,564 | 2/1992 | Chimienti | 206/365 |
| 5,282,537 | 2/1994 | Wong | 206/485 |

FOREIGN PATENT DOCUMENTS

| | | | |
|---|---|---|---|
| 2 534 466 | 10/1983 | France . | |
| 2534466 | 10/1983 | France . | |
| 860 851 | 12/1952 | Germany . | |
| 860851 | 12/1952 | Germany . | |
| 7326317 | 10/1973 | Germany . | |
| 403289464A | 12/1991 | Japan | 220/4.23 |

*Primary Examiner*—Peter M. Cuomo
*Assistant Examiner*—Stephen Vu
*Attorney, Agent, or Firm*—Sixbey, Friedman, Leedom & Ferguson; David S. Safran

[57] ABSTRACT

A holding device in which two side parts are provided which lie against one another with one edge region of each side part being encircled by an elastic ring or rubber band that is detachably fixed in the noted edge region. Furthermore, each of the side parts has at least one recess whose contour corresponds substantially to the contour of an object to be held, and heightwise corresponds in the vertical direction to the dimensions of the object, or is larger than the latter, while at least sections of the at least one recess are dimensionally smaller in a horizontal or widthwise direction than the corresponding dimension of the object to be held.

9 Claims, 5 Drawing Sheets

HOLDING DEVICE

BACKGROUND OF THE INVENTION

1. Field of the Invention

The invention relates to a holding device for voluminous objects, in particular containers of all kinds.

2. Description of Related Art

Holding devices of this type are known, for example, as so-called displays in which the object to be held is laid out, exhibited, or made available for viewing.

Other holding devices of the type mentioned are holders or stands for individual bottles, vases, bowls, lamps, etc.

SUMMARY OF THE INVENTION

A primary object of the invention is to provide a holding device for containers of all kinds that is simply constructed, yet satisfactorily fulfills the holding purpose.

It is a further object of the invention to provide a holding device for containers of all kinds that is economical, can be produced in large quantities, can be packaged in a space-saving way.

Yet another object of the invention is to provide a holding device for containers of all kinds that can be assembled and/or implemented for its function in a simple way by the user, and requires little space to be used.

The objects according to the invention is achieved by a holding device according to a preferred embodiment of the invention in which two side parts are provided which lie against one another with one edge region of each side part being encircled by an elastic ring or rubber band that is detachably fixed in the edge region mentioned. Furthermore, each of the side parts has at least one recess whose contour corresponds substantially to the contour of an object to be held, and heightwise corresponds in the vertical direction to the dimensions of the object, or is larger than the latter, while at least sections of the at least one recess are dimensionally smaller in a horizontal direction than the corresponding dimension of the object to be held.

These and other objects, features and advantages of the invention will become apparent from the following description and accompanying drawings which show, for purposes of illustration only, a single embodiment in accordance with the present invention.

BRIEF DESCRIPTION OF THE PREFERRED EMBODIMENT

Figure 1:
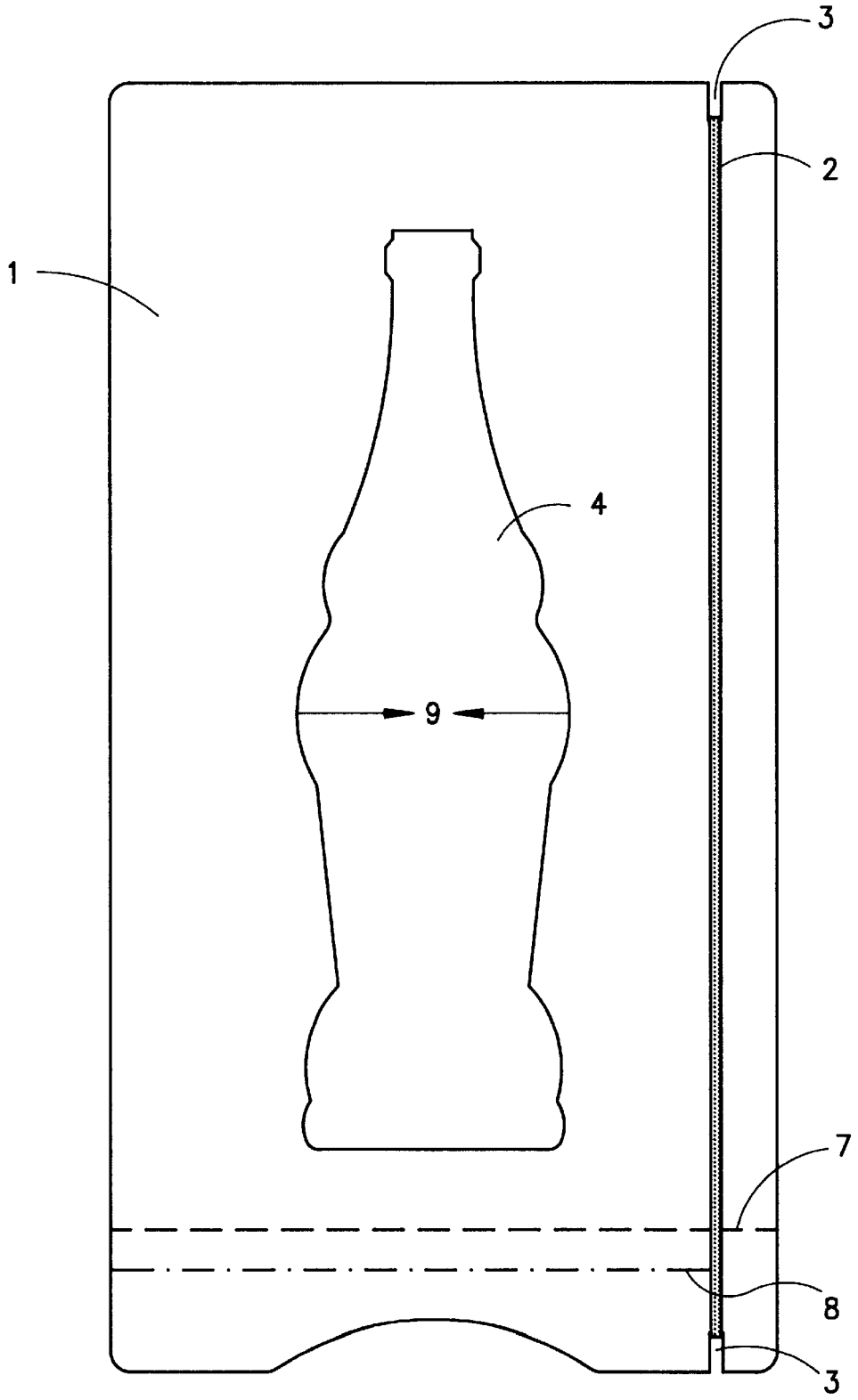
FIG. 1 is a diagrammatic side view of an embodiment of the holding device according to the invention for a bottle-shaped object.

The preferred embodiment of the holding device according to the invention shown in FIG. 1 has two congruent side parts 1. These side parts can be made of any solid material, in particular of wood, plastic or metal; although, the preferred material is wood.

The embodiment of the holding device according to the invention shown in FIG. 1 is for holding a Coca-Cola® bottle having a height of about 20 cm, and both side parts 1 have a width of about 14 cm and a height of about 27 cm. In the region of the right, vertical, superposed edges of side parts 1, a elastic ring 2 encircles both side parts 1. Encircling elastic ring 2 is supported in this edge region of the side parts in a suitable way, such that it cannot come out of its placement in this region and become parallel to the adjacent outer edges of the side parts 1; in this embodiment, the fixing means for the elastic ring 2 is formed by U-shaped recesses 3 in the upper and lower edge area of side parts 1, adjacent to the superposed vertical edges of side parts 1.

The width of side parts 1 is shown by dashed line 7; the distance between the left edge of side parts 1 and encircling elastic ring 2 is indicated by line 8. The distance indicated by line 8 is about 90% of the distance indicated by line 7.

A recess or opening 4 is made about in the middle of the side parts 1. This opening 4 corresponds in shape to the contour of a common Coca-Cola® bottle with the difference being that the bottle shape is compressed about 9 to 10% in the widthwise or horizontal direction 9, so that the actual bottle can pass partially, but not completely, through the opening 4.

If the compression of the shape of opening 4 relative to the vertical center axis (in this case: the axis of rotation) in comparison to contour of the object to be held does not occur, the edges of recess 4 will radially encircle the inserted object, so that the type of holding according to the invention does not occur. With such compression, for example, by 10%, the edges of recess 4 encircle the inserted object secantially, so that holding occurs. With increasing compression, the encircling transitions finally merge into a tangential bearing of the side parts 1 on the object to be held, at which point, a holding of the type according to the invention no longer occurs.

According to the invention, the compression can also be selected such that the upper edge of recess 4 rests secantially on the closure of the container to be held, so that the latter is held in the holding device in a state in which it cannot be opened.

Figure 2:
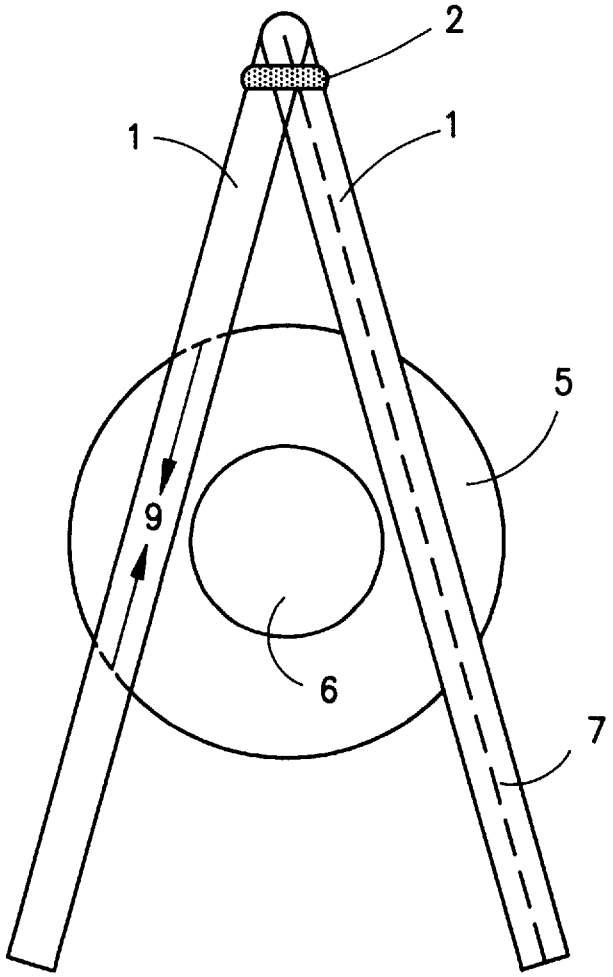
FIG. 2 is a diagrammatic plan view of the holding device according to the invention shown with a bottle is held thereby.

FIG. 2 shows the preferred embodiment of the holder according to the invention of FIG. 1 in a top view, with a bottle 5 having a bottle opening 6 held in the holding device. The reference symbols of FIG. 2 correspond to those of FIG. 1.

Figure 3:
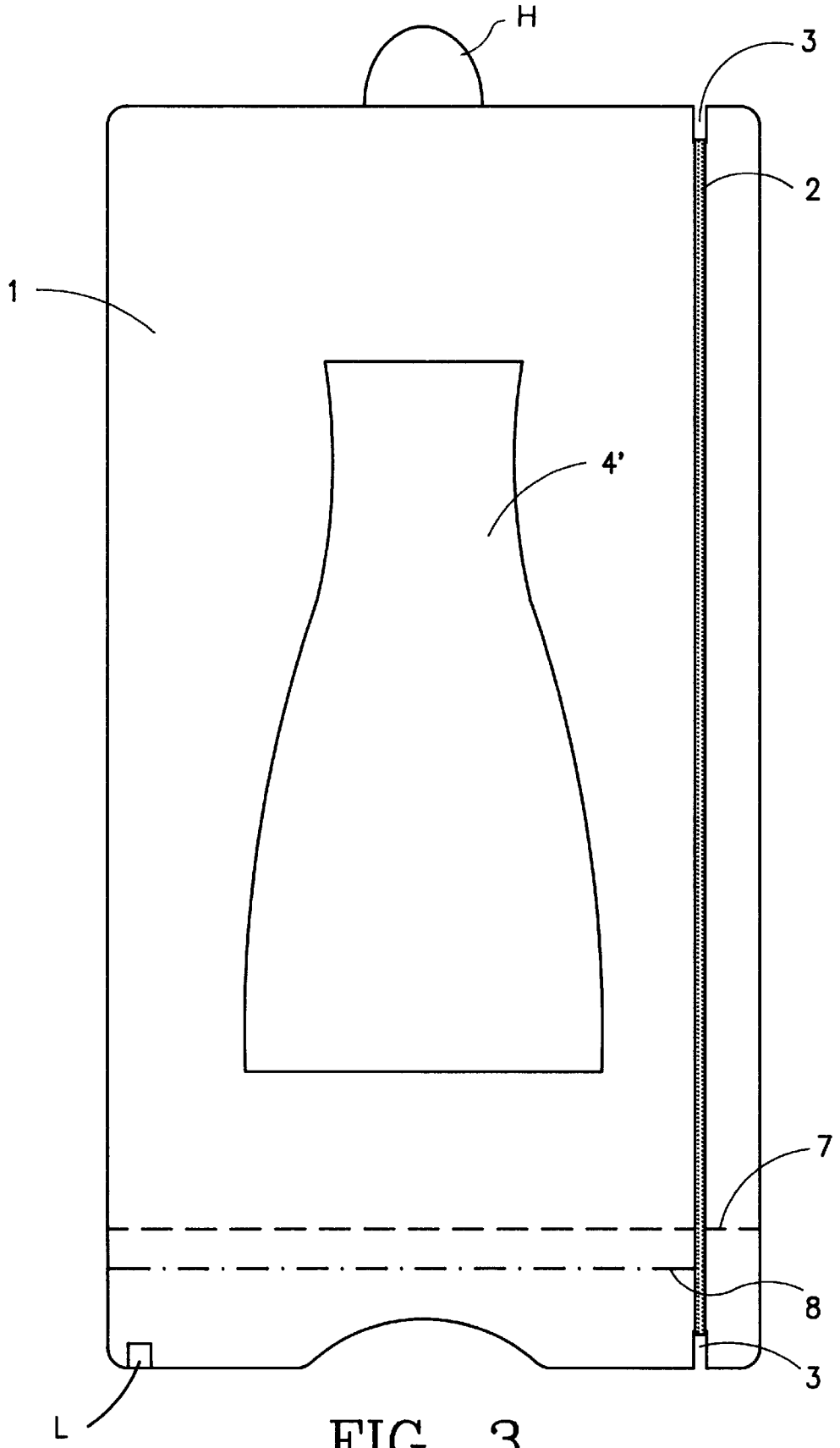
FIG. 3 is a view corresponding to that of FIG. 1 but showing a holding device for a vase-shaped object.
Figure 4:
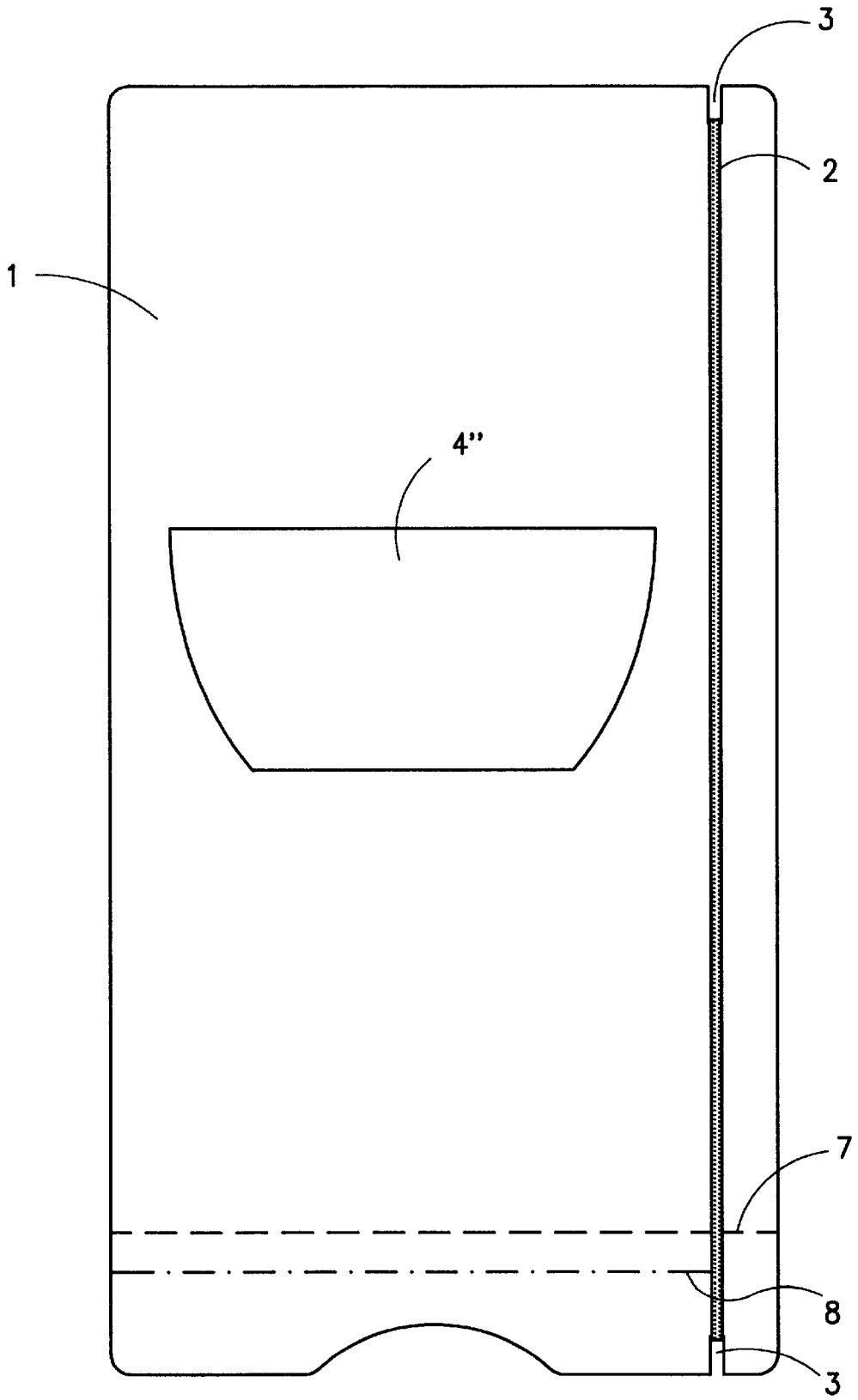
FIG. 4 is a view corresponding to that of FIG. 1 but showing a holding device for a bowl-shaped object.
Figure 5:
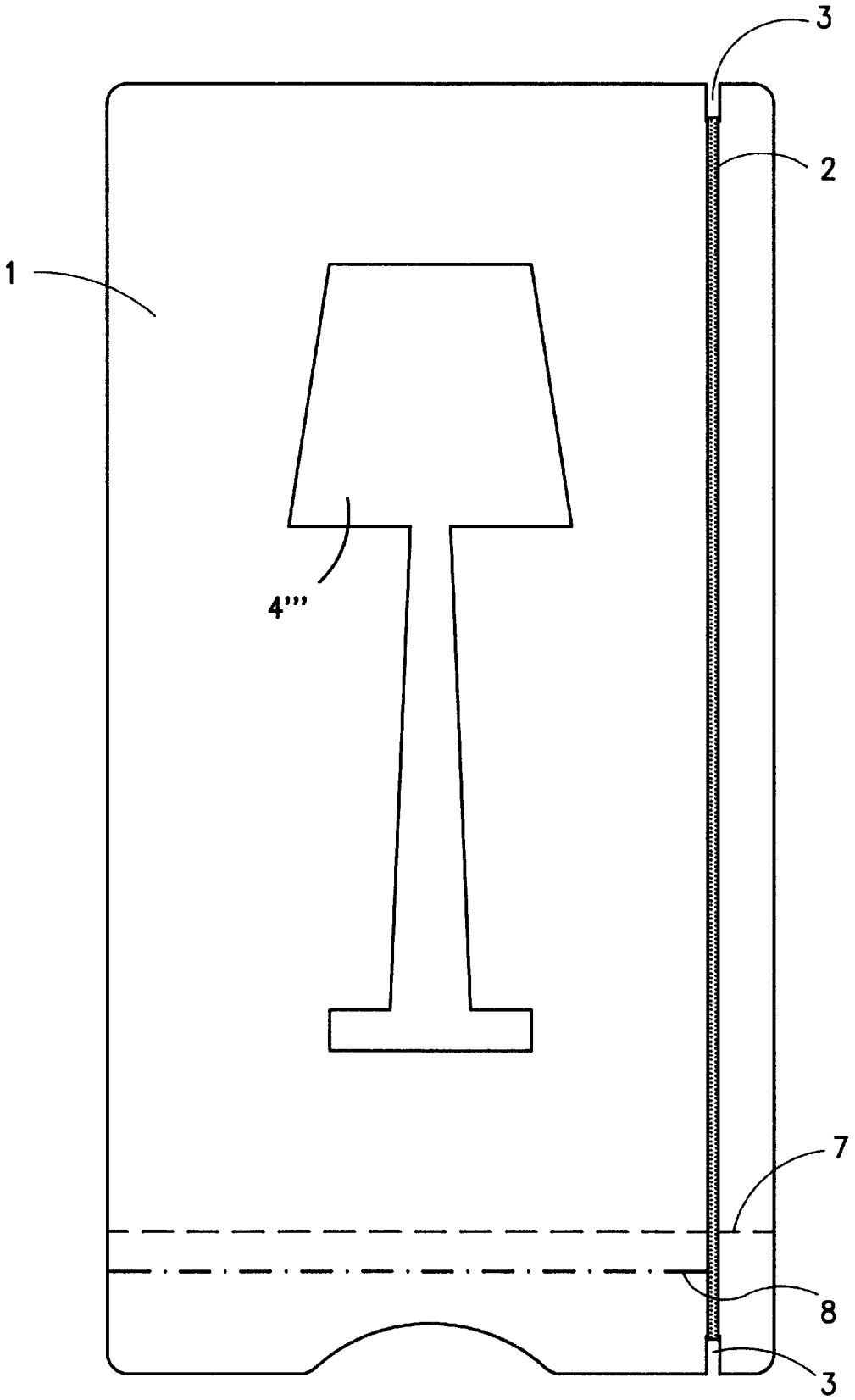
FIG. 5 is a view corresponding to that of FIG. 1 but showing a holding device for a lamp-shaped object.

It should be apparent that the holding device of the invention is suitable for use with all types of containers or objects, especially those that are rotationally symmetric, the illustrate Cokes® bottle merely being one example. FIGS. 3–5 show other such examples as a vase-shaped recess 4', a bowl-shaped opening 4" and a lamp-shaped opening 4'". The holder can be designed not only in the form of a display for exhibiting the object. Rather, the holder is preferred as a stand for containers, such as bowls and bottles, so that the latter can be used as flower vases, lamps or also as storage containers.

It can be seen from the description and figures that side parts 1 can be varied in multiple ways with respect to their outer contour and shape, without negatively influencing their technical function. Thus, for example, side surfaces 1 can be designed in a curved, ornamental, or foliated way; the surfaces located next to recess 4 can be shaped in two or three dimensions, and the designs can considerably increase the aesthetic or practical use of the object to be held. This is true, for example, for simple food containers, such as glasses and bowls, which normally are thrown away; with a holding device of the type according to the invention, the former can now be assigned a practical or decorative purpose, for example, as a flower vase, and the aesthetic design of side parts 1 can open possibilities for new aesthetic effects.

Side parts 1 can be provided, on the edge opposite the encircling elastic ring, in the region of the edge on which they are standing, with additional support means or the like, to increase the stability of the holding device according to the invention, if needed. In this regard, FIG. 3 shows a leg L laterally projecting from one side part 1 as one example, a similar leg projecting in an opposite direction from the other side part 1.

Encircling elastic band 2 can made of any material that has a resiliency comparable to that of a rubber band. The elastic ring 2 used in the embodiment has a circular cross section with a diameter of about 3 mm and a length of about 34 cm, which is stretched to about 50 cm if the ring is in its fixing position in fixing means 3 of side parts 1.

Knowing this description and examples, one skilled in the art can find the necessary sizes with respect to recess 4, ring 2, distances 7 and 8 as a function of the object to be held, in a simple way and with few tries.

If needed, the holding device according to the invention can also be used as a carrying device for the objects mentioned and the like, and in such a case, a suitable handle is attached on or to the side parts 1 in the region of the superposed edges of the side parts, near the encircling elastic ring 2. Likewise, the holding device can be provided with means for hanging it on a wall or on a ceiling, e.g., as a lamp holder, and as an example, a hanging strap H is shown in FIG. 3.

While various embodiments in accordance with the present invention have been shown and described, it is understood that the invention is not limited thereto, and is susceptible to numerous changes and modifications as known to those skilled in the art. Therefore, this invention is not limited to the details shown and described herein, and includes all such changes and modifications as are encompassed by the scope of the appended claims.

I claim:

1. A holding device in combination with an object to held, said holding device 1 two side parts, said side parts lying against one another at least at an edge region thereof and being detachably connected together by an elastic ring which encircles the side parts in said edge region on one end of the holding device and enables said side parts to be spaced apart at portions, thereof that are displaced from said edge region at an opposite end of the holding device; wherein each of said side parts has at least one recess with a contour which approximately corresponds to the contour of the object, each of said recess having dimensions in a vertical direction at least as large as corresponding dimensions of the object and having dimensions in a horizontal direction which are, at least in sections, smaller than corresponding dimensions of the object, in order for said object to be resiliently held between said side parts with said side parts being spaced apart at said portions thereof that are displaced from said edge region and with said object extending only partially into said at least one recess of each of said parts side and partially exposed therebetween.

2. The combination according to claim 1, wherein the object is vase-shaped and said at least one recess in each of the side parts has a shape that corresponds to the contour of the vase shape of the object in a vertical direction and is compressed by about 5–30% relative to said vase shape in a horizontal direction.

3. The combination according to claim 1, wherein the object is vase-shaped and said at least one recess in each of the side parts has a shape that corresponds to the contour of the vase shape of the object in a vertical direction and is compressed by about 10–20% relative to said vase shape in a horizontal direction.

4. The combination according to claim 1, wherein the object is a bottle and said at least one recess in each of the side parts has a shape that corresponds to the contour of the bottle in a vertical direction and is compressed by about 5–30% relative to the bottle's contour in a horizontal direction.

5. The combination according to claim 1, wherein the object is a lamp and said at least one recess in each of the side parts has a shape that corresponds to the contour of the bottle in a vertical direction and is compressed by about 10–20% relative to the bottle's contour in a horizontal direction.

6. The combination according to claim 1, wherein the object is a lamp and said at least one recess in each of the side parts has a shape that corresponds to the contour of the lamp in a vertical direction and is compressed by about 5–30% relative to the lamp's contour in a horizontal direction.

7. The combination according to claim 1, wherein object is a bowl and the at least one recess in each of the side parts has a shape that corresponds to the contour of the bowl in a vertical direction and is compressed by about 5–30% relative to the lamp's contour in a horizontal direction.

8. The combination according to claim 1, wherein additional support means are attached to the side parts in a bottom area thereof on which the side parts stand.

9. The combination according to claim 1, further comprising means for hanging the device on a wall or a ceiling.

* * * * *